US005601515A

United States Patent [19]

Matsumoto

[11] Patent Number: 5,601,515

[45] Date of Patent: Feb. 11, 1997

[54] ADJUSTABLE RECUMBENT BICYCLE EXERCISER

[75] Inventor: Masaaki Matsumoto, Sakai, Japan

[73] Assignee: Cat Eye Co., Ltd., Osaka, Japan

[21] Appl. No.: 216,078

[22] Filed: Mar. 21, 1994

Related U.S. Application Data

[63] Continuation of Ser. No. 907,163, Jul. 1, 1992, abandoned.

[30] Foreign Application Priority Data

Jul. 5, 1991 [JP] Japan ..... 3-052147 U

[51] Int. Cl.[6] ..... A63B 21/00

[52] U.S. Cl. ..... 482/57; 482/908

[58] Field of Search ..... 482/57, 70, 56, 482/54, 908

[56] References Cited

U.S. PATENT DOCUMENTS

| | | | |
|---|---|---|---|
| 4,344,616 | 8/1982 | Ogden | 482/54 |
| 4,374,587 | 2/1983 | Ogden | 482/54 |
| 4,406,451 | 9/1983 | Gaetano | 482/54 |
| 4,759,540 | 7/1988 | Yu | 482/54 |
| 4,911,438 | 3/1990 | Van Straaten | 482/96 |
| 4,953,850 | 9/1990 | Lo | 482/57 |
| 5,029,848 | 7/1991 | Sleamaker | 482/96 |
| 5,058,881 | 10/1991 | Meason | 482/54 |
| 5,072,929 | 12/1991 | Peterson et al. | 482/72 |

*Primary Examiner*—Stephen R. Crow
*Attorney, Agent, or Firm*—Banner & Witcoff, Ltd.

[57] ABSTRACT

An exerciser according to the present invention includes a load portion in which a load device for applying a load to turn of a pedal is incorporated, a seat frame to which a seat for a user is fixed and having one end connected to the load portion, an end frame fixed to the other end of the seat frame and having a cylindrical shape, a seat post formed to be slidable into the end frame and having one end located on a floor, and a fixing device for fixing the end frame at a desired slide position of the seat post.

10 Claims, 7 Drawing Sheets

ADJUSTABLE RECUMBENT BICYCLE EXERCISER

This application is a Continuation of application Ser. No. 07/907,163, filed Jul. 1, 1992, now abandoned.

BACKGROUND OF THE INVENTION

1. Field of the Invention

The present invention relates generally to pedalling exercisers, and more particularly, to an exerciser which enables a user to practice various pedalling exercises in a lying-down position.

2. Description of the Background Art

FIG. 8 is a diagram showing the structure of a conventional exerciser by which a user practices pedalling exercise in a lying-down position disclosed in U.S. Pat. No. 4,953,850.

The structure will be described in the following with reference to the figure.

Rotation of a pedal 69 attached to the end portion of a crank arm 71 causes a pedal shaft 3 to rotate. A load device 5 for applying a load to the rotation is provided covered by a frame cover 7 The load device 5 is attached to one end of a center post 11 having a forward lower portion fixed to a leveller pipe 20. Casters 21 are attached to opposite ends of the leveller pipe 20. The other end of the center post 11 is slidable into a seat frame 23 and the end portion of the seat frame 23 is bent in a L-shape manner, constituting a leg 73. Fixed on the seat frame 23 is a seat 29 on which a user who practices pedalling exercise sits. A handle 27 for stabilizing an exercise is attached to the lower portion of the seat 29.

When using the exerciser in practice, an user releases a lock pin 25 to change a sliding position of the center post 11 and the seat frame 23 according to the physique of the user and fixes the lock pin 25 at a position according to his form, thereby determining a positional relationship between the seat 29 and the pedal. Such adjustment allows an appropriate pedalling exercise according to users of various physique.

Although such conventional exerciser, by which pedalling exercise is practiced in a lying-down position as described above, enables an adjustment of space between the seat and the pedal according to the physique of an user, the adjustment is not satisfactory for bringing out a good effect from the pedalling exercise in a lying-down position.

In the pedalling exercise practiced in a lying-down position, the momentum load of the pedalling exercise is changed according to a relative difference in height between the lying-down position, that is, the central position of the pedal shaft and the seat. In other words, when the seat is arranged at a relatively low position with respect to the pedal shaft, a load on the cardiopulmonary function of the user is increased to enable a hard pedalling exercise. On the other hand, the load of the pedalling exercise can be decreased by setting the seat at a position of the same or higher level than that of the pedal shaft, which makes the pedalling exercise suitable for one of rehabilitation exercises for the sick etc. Thus, a seat which can be vertically adjusted with respect to a pedal shaft allows the same device to be used for pedalling exercise practiced in a lying-down position according to a cardiopulmonary function of an user and the condition of a disease of a sick person.

As shown in FIG. 8, a structure of a conventional exerciser by which an user practices a pedalling exercise in a lying-down position, however, has a seat which height can not be adjusted. Thus, it is not easy for the user to practice a pedalling exercise with various loads by using a single exerciser.

SUMMARY OF THE INVENTION

An object of the present invention is to allow an user to take a suitable lying-down position when using an exerciser by which a pedalling exercise is to be practiced in a lying-down position.

In order to achieve the above-described object, an exerciser according to the present invention by which a pedalling exercise is practiced in a lying-down position, includes a load portion with a load device incorporated therein for applying a load to pedal turn, a seat frame to which a seat for a user is fixed and having one end connected to the load portion, an end frame fixed to the other end of the seat frame and having a cylindrical form, a seat post slidable into the end frame and having one end positioned on a floor, and a fixing means for fixing the end frame at an arbitrary slide position with respect to the seat post.

The exerciser structured as described above has a vertically adjustable seat, thereby facilitating the user to take a desired lying-down position.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
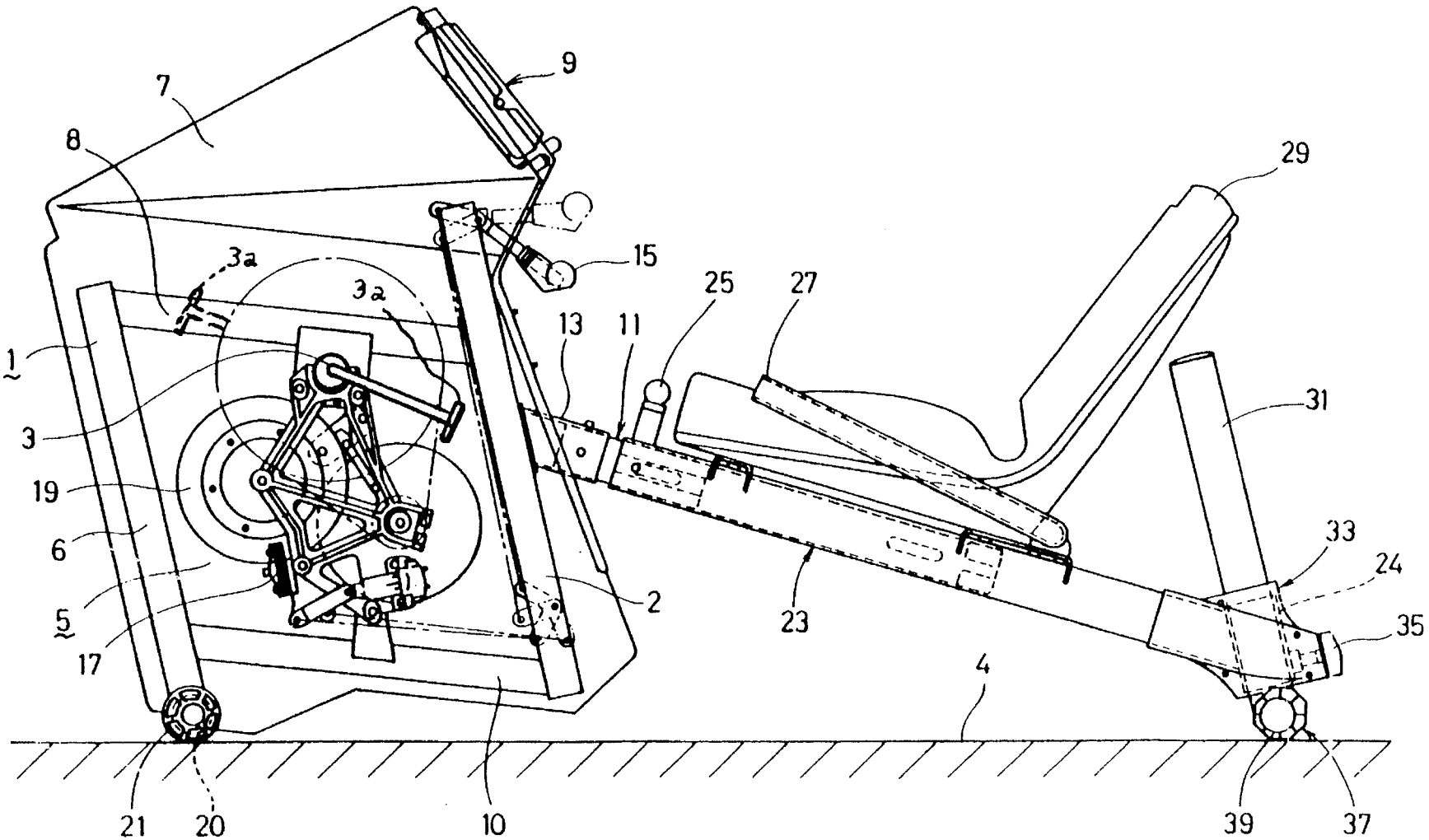
FIG. 1 is a side view of an exerciser according to a first embodiment of the present invention.

FIG. 1 is a side view showing an exerciser according to a first embodiment of the present invention.

The structure will be described in the following with reference to the figure.

A frame 1 for incorporating a load device 5 for applying a load through a pedal shaft 3 to be rotated by pedals **3*a* is set up by using four square pipes, for example. The frame 1 is structured by a front frame 6, a rear frame 2, an upper frame 8 and a lower frame 10. The load device 5 for applying a load to the rotation of the pedal shaft 3 is fixed between the upper frame 8 and the lower frame 10. The load device according to the present embodiment employs an eddy current system for applying a load by causing a copper disk 19 to generate an eddy current through a permanent magnet 17. Adjustment of the load is made by upwardly/downwardly shifting a change lever 15 attached at the upper portion of the rear frame 2 to change the relative position between the permanent magnet 17 and the copper disk 19**.

Fixed to the lower portion of the front frame 6 is a leveller pipe 20, and attached to the opposite ends of the leveller pipe 20 are casters 21 which are used for shifting the exerciser and serving as a fulcrum of the load device during the exercise. The load device 5 and the frame 1 are fully covered with a frame cover 7, and a control unit 9 is attached to the upper portion on the user's side of the frame cover 7. The control unit 9 enables setting of various loads and program contents etc. for pedalling exercise.

Fixed to the central portion of the rear frame 2 is a bracket 13 to which a center post 11 made of a square pipe is attached. The center post 11 can be freely inserted into the seat frame 23 made of a square pipe and to which the seat 29 is fixed. Attachment/detachment of a lock pin 25 adjusts the extent of insertion of the center post 11 into the seat frame 23, that is, the horizontal distance between the seat 29 and the pedal shaft 3.

The other end of the seat frame 23 is fixed to an end frame 24 made of a square pipe. A seat post 31 made of a square pipe is formed to be slidable in the end frame 24 and has an end portion, on the floor side, to which a seat leveller pipe 39 is attached. Attached to the leveller pipe 39 is an octangular leveller pipe 37 to be used to adapt to curve such as horizontally of the floor 4 etc. A post cover 33 formed for example, of plastic is attached to the crossing-over point between the seat frame 23 and the seat post 31. Attached to the post cover 33 is a post knob 35 for adjusting a slide positional relationship between the end frame 24 and the seat post 31.

Figure 2:
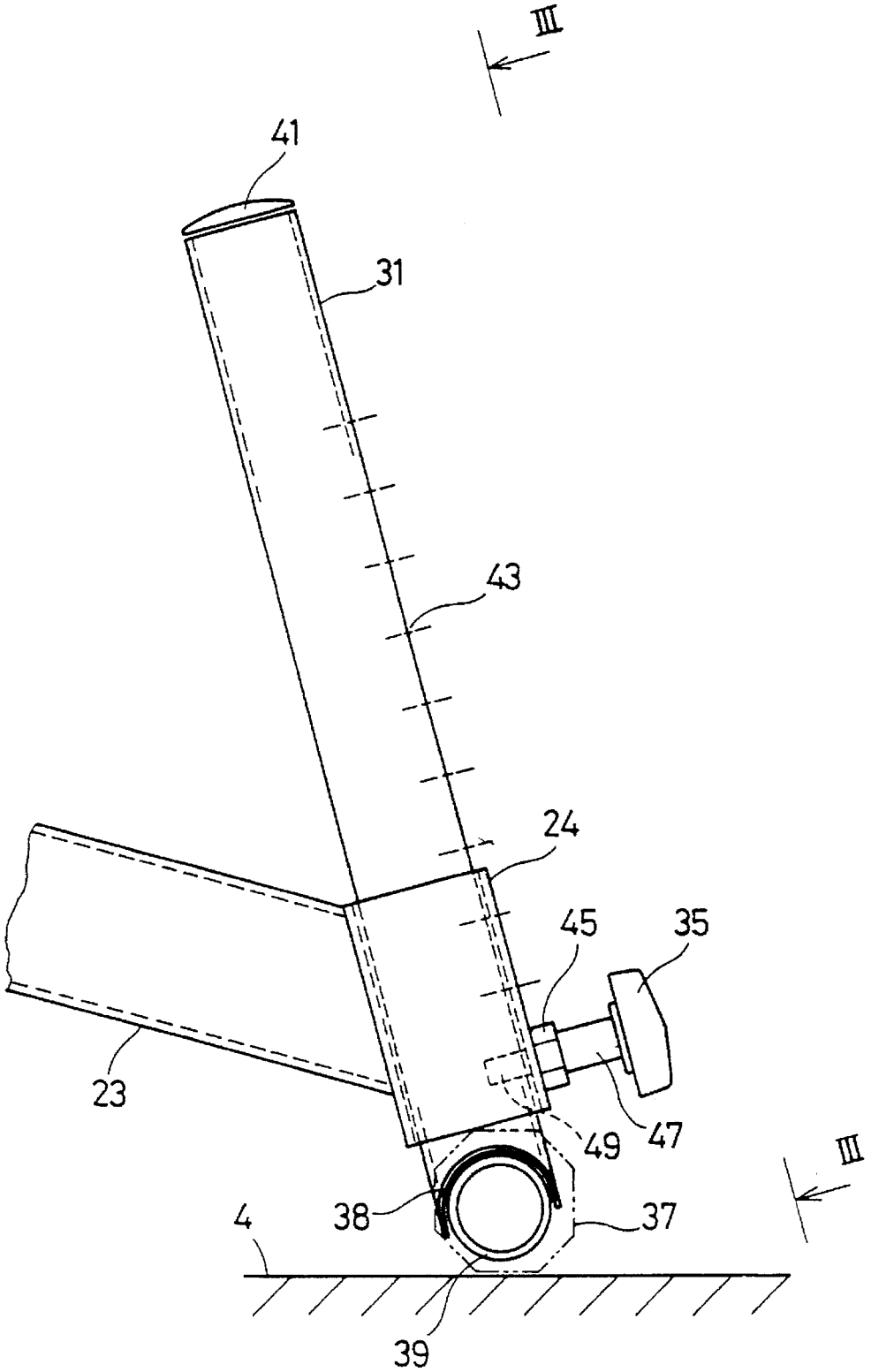
FIG. 2 is a detail view showing an arrangement of a crossing-over portion of the seat frame 23 and the seat post 31.
Figure 3:
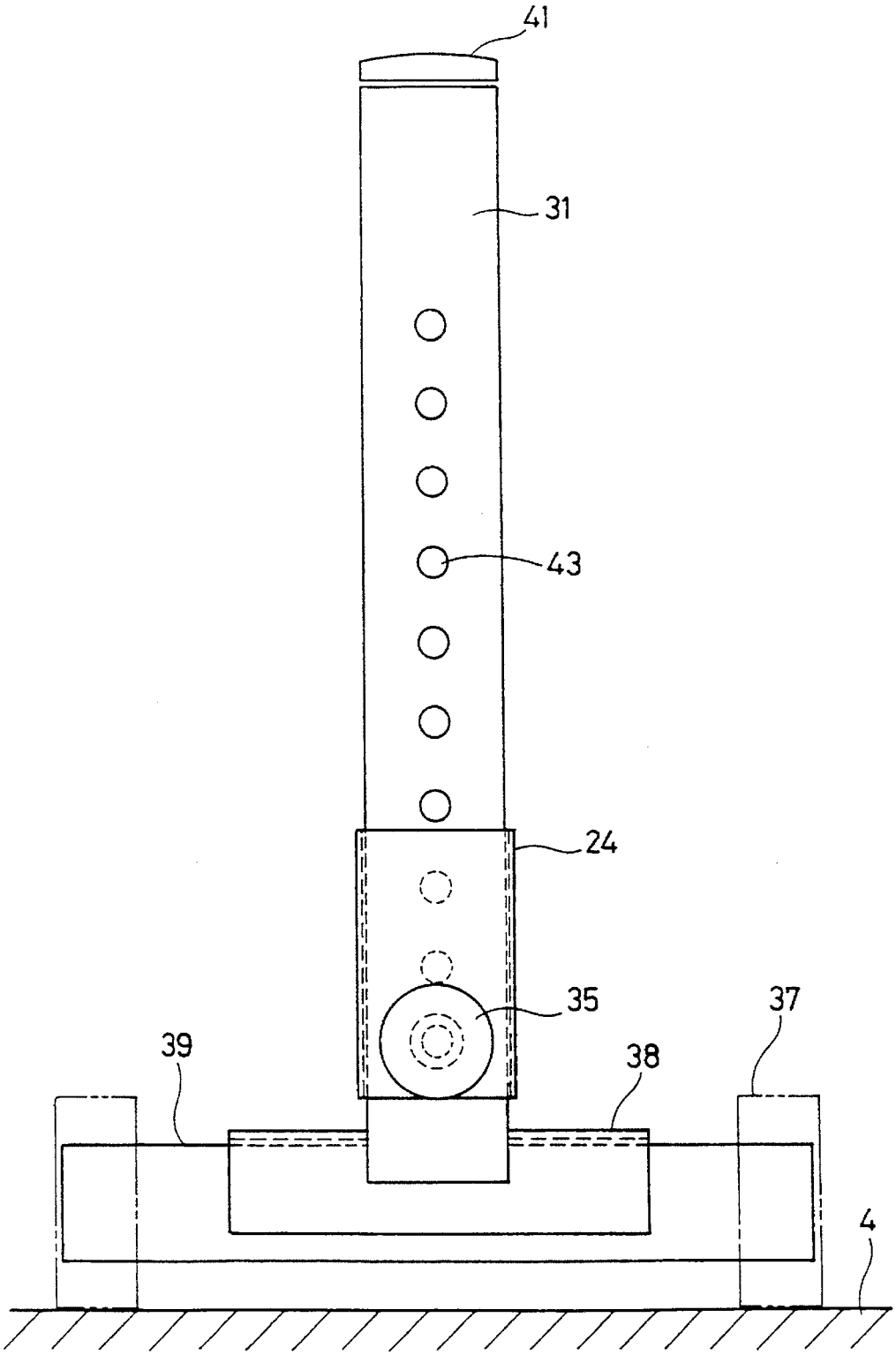
FIG. 3 is a view taken along the line III—III of FIG. 2.

FIG. 2 is a view of the structure showing an attachment between the seat frame 23 and the seat post 31 and FIG. 3 is a view taken along line III—III of FIG. 2.

The structure will be described in the following with reference to the figures.

The seat frame 23 made of a square pipe is welded to the end frame 24 also made of a square pipe. The seat post 31 made of a square pipe is sized to be slidable inside the end frame 24 and has one side provided with openings 43 at a predetermined pitch. A nut 45 is fixed to the lower portion of the end frame 24. Provide on the side of the end frame 24 to which the nut 45 is attached is an opening corresponding to the diameter of the nut, through which opening a rod 47 having a tip portion 49 to be engaged with the openings 43 provided on the seat post 31 is engaged with the nut 45. Attached to the end portion of the rod 47 is the post knob 35 made of plastic resin and the like. Attached to the upper end portion of the seat post 31 is a cap 41 and fixed to the lower end portion of the same is a base pipe 38 shaped to a half cut of a circular pipe. Attached to the base pipe 38 is the leveller pipe 39 made of a circular pipe and attached to the opposite ends of the pipe 39 are a pair of octangular leveller pipes 37. The center of the leveller pipe 37 is eccentric to the center of the pipe 39. In order to put the exerciser horizontally with the curve of the floor 4 etc., the octangular leveller pipe 37 is turned to adjust a positional relationship between the floor 4 and the leveller pipe 39.

The following is a description of an adjustment method for changing a slide positional relationship between the seat frame 23 and the seat post 31.

First, by turning the post knob 35, the rod 47 is disengaged from the nut 45 to detach the tip portion 49 from the opening 43 of the seat post 31. The detachment of the post knob 35 from the end frame 24 allows the end frame 24 and the seat post 31 to slide freely, whereby the end frame 24 can be shifted to a desired slide position with respect to the seat post 31. Shifting the end frame 24 upwards from the floor 4 results in the frame 1 and the seat frame 23 integrally shifting counterclockwise around the caster 21 as shown in FIG. 1. In other words, by thus shifting the seat frame 23, a relative vertical position of the seat 29 is changed with respect to the position of the pedal shaft 3.

Figure 4:
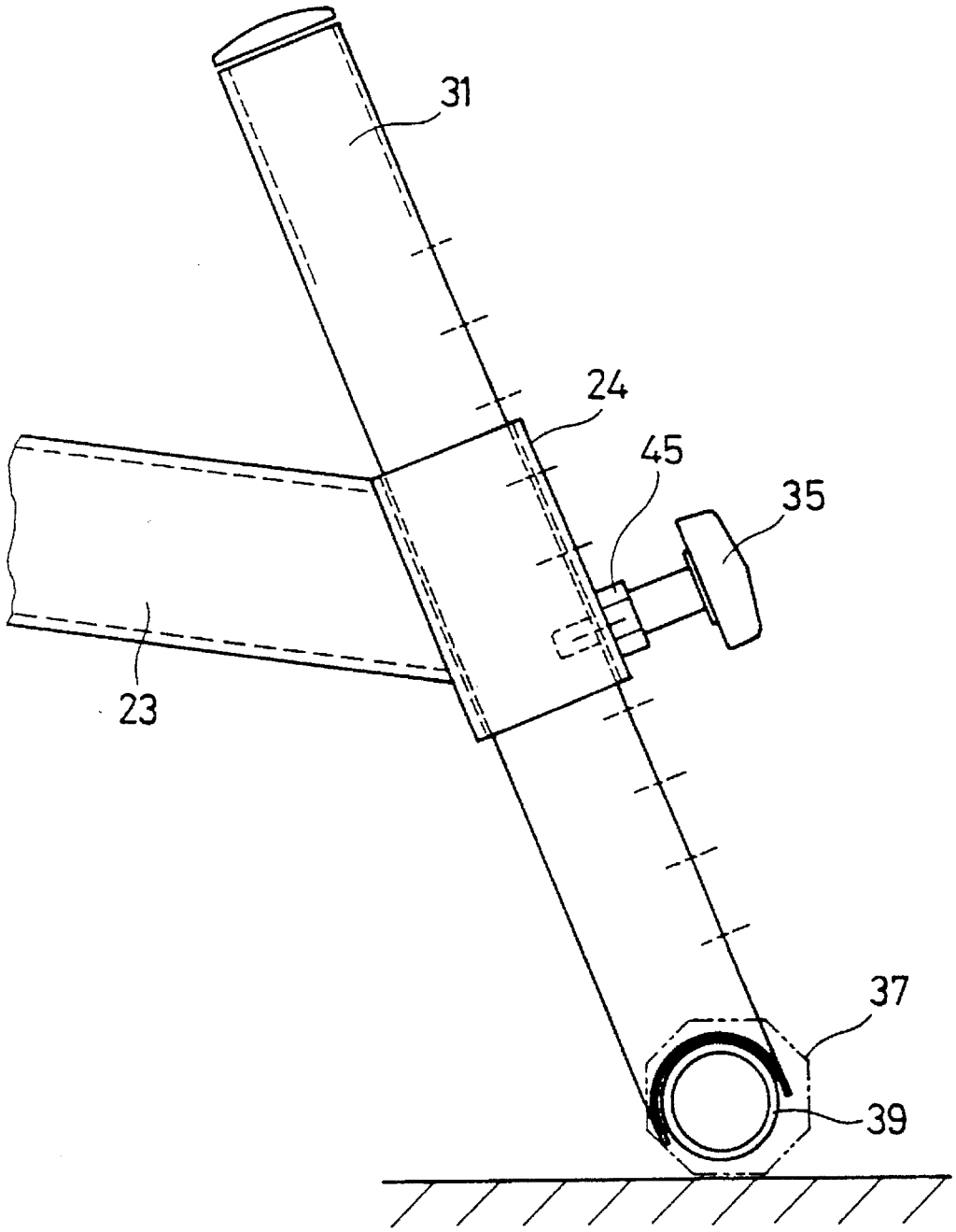
FIG. 4 is a view showing an attachment of the seat frame 23 upwardly adjusted from the floor, to the seat post 31 of the exerciser shown in FIG. 1.

FIG. 4 shows another attachment of the post knob 35 to the nut 45, with the opening provided on the end frame 24 set to the opening 43 provided on the upper portion of the seat post 31. As described in the foregoing, the horizontal positional relationship between the seat 29 and the pedal shaft 3 can be adjusted by using the lock pin 25, while the vertical positional relationship between the seat 29 and the pedal shaft 3 can be easily adjusted by using the post knob 35.

Figure 5:
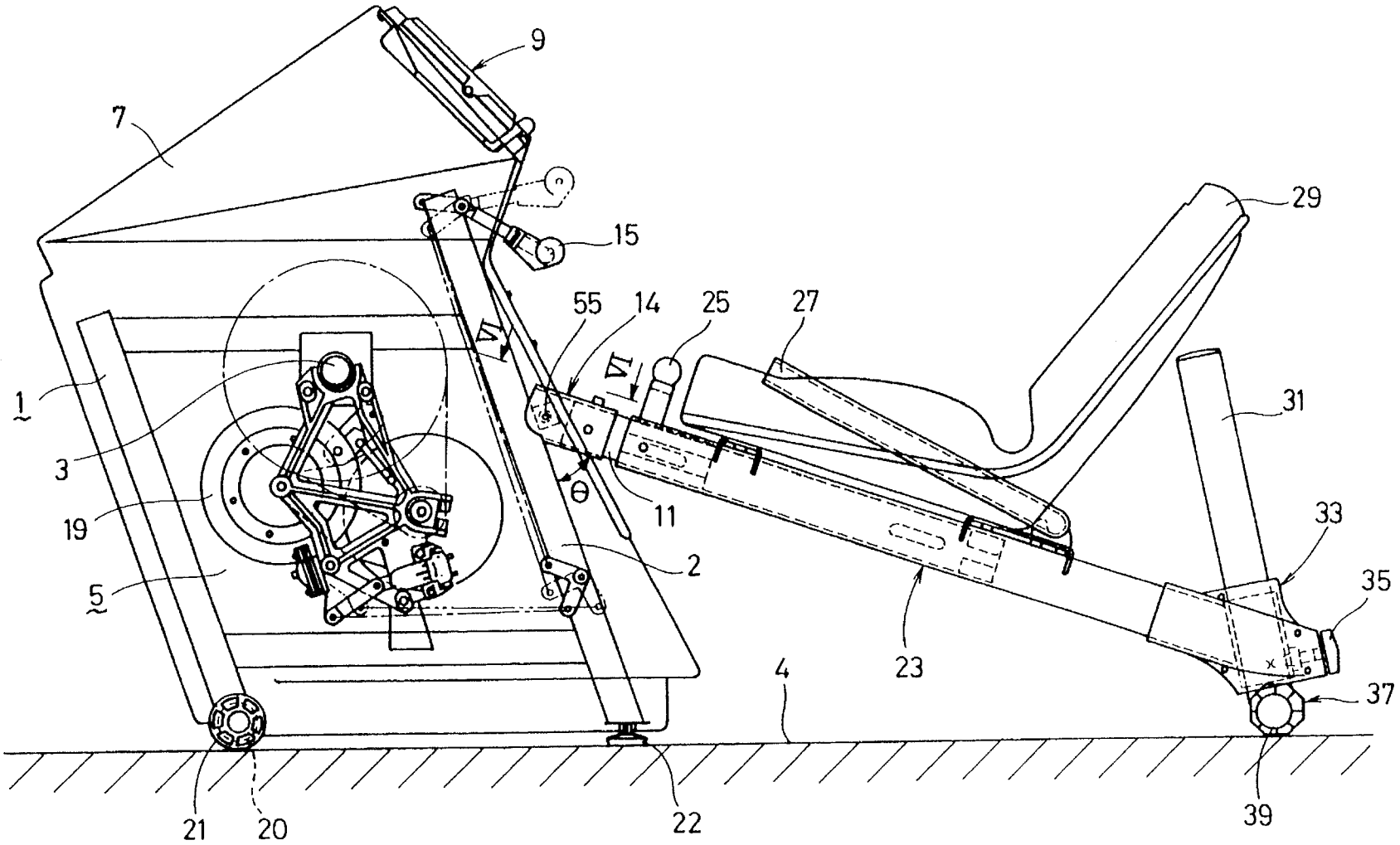
FIG. 5 is a side view showing the structure of an exerciser according to a second embodiment of the present invention.
Figure 6:
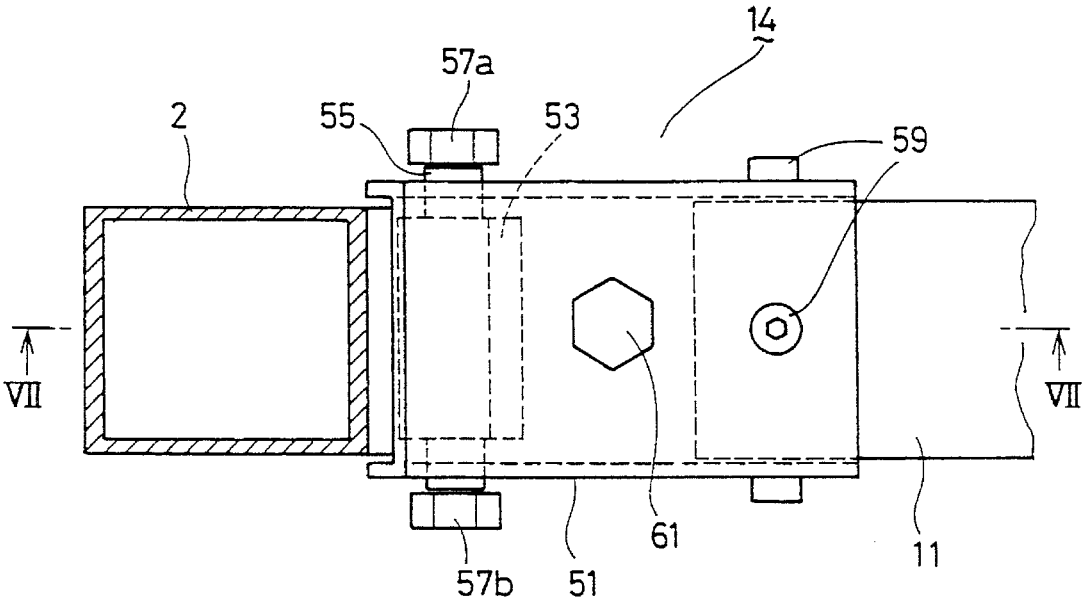
FIG. 6 is a sectional view taken along line VI—VI of FIG. 5.
Figure 7:
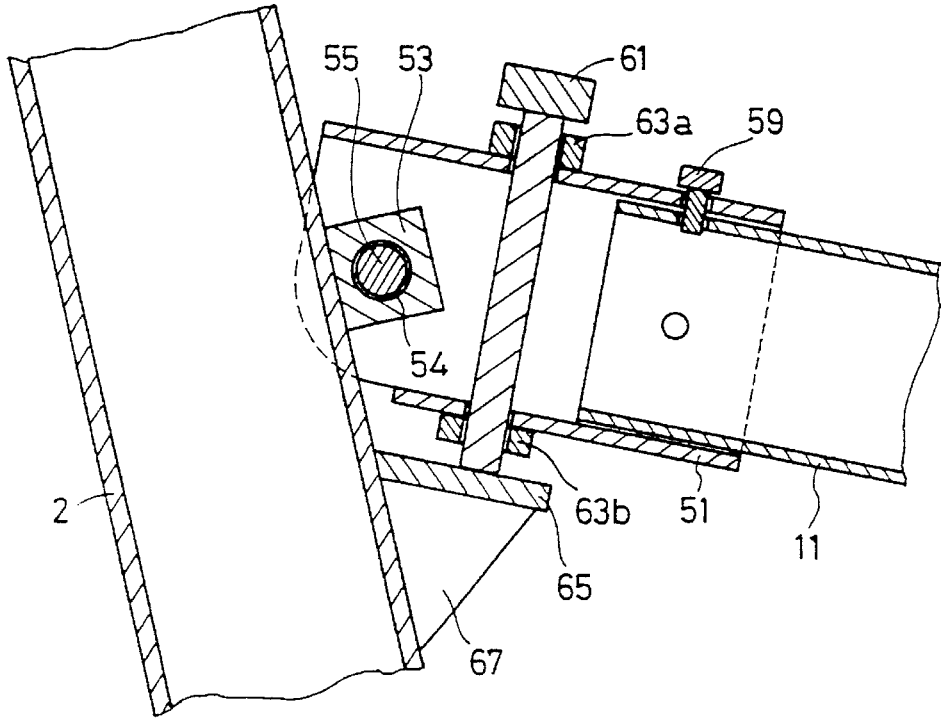
FIG. 7 is a sectional view taken along line VII—VII of FIG. 6.
Figure 8:
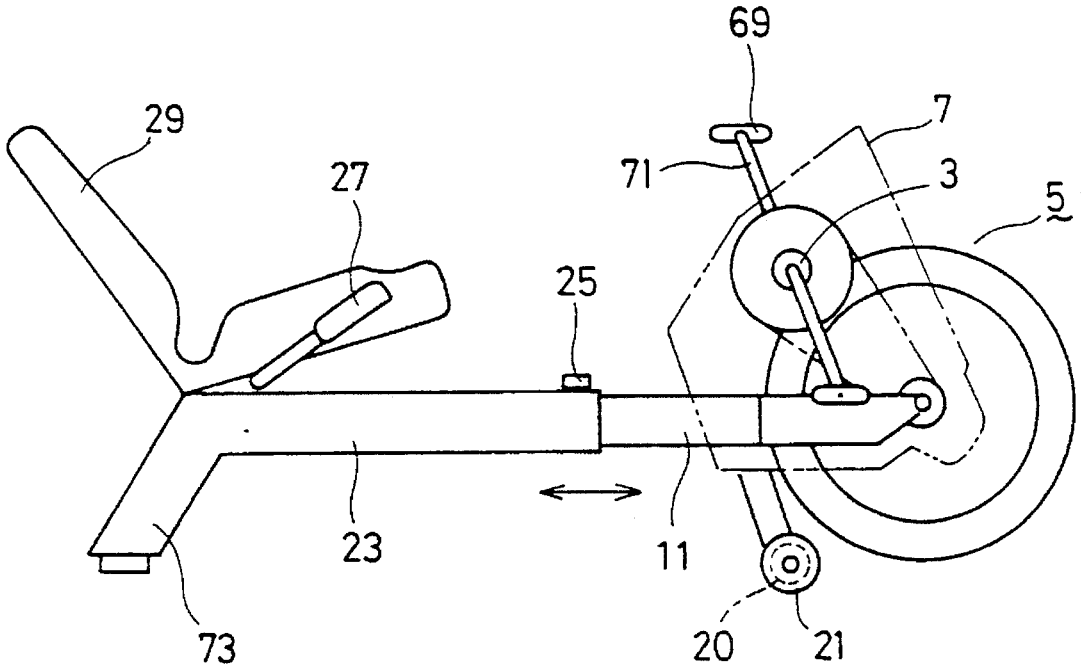
FIG. 8 is a side view showing the structure of a conventional exerciser by which a user practices a pedalling exercise in a lying-down position.

FIG. 5 is a side view of an exerciser according to a second embodiment of the present invention, FIG. 6 is a sectional view taken along line VI—VI of FIG. 5 and FIG. 7 is a sectional view taken along line VII—VII of FIG. 6. The structure will be described in the following with reference to these figures.

The structure of the exerciser according to the second embodiment differs from that of the previously described first embodiment in that the bracket 14 in which the center post is secured is not fixed to the rear frame 2 constituting the frame 1 but rotatably attached to the rear frame 2 and that the leveller 22 is attached to the lower portion of the rear frame 2. The other part of the structure is the same as that of the first embodiment and therefore description is not repeated of that part but is made of the different points.

Fixed to the surface, on the seat side, of the rear frame 2 is a bearing 53 provided with an opening 54 through which a shaft 55 can be inserted freely. Openings corresponding to the shaft 55 are provided on the opposite sides of a channel member 51 constituting the bracket 14, thereby allowing the bracket 14 to be rotatable around the shaft 55. Formed on the opposite end portions of the shaft 55 are tapped holes to which bolts **57*a* and 57*b* are attached to engage therewith, thereby preventing the channel member 51 from detaching from the shaft 55**.

The center post 11 is inserted into the end portion of the channel member 51 opposite to the rear frame 2 and a fixing pin 59 is attached to the periphery of the insertion portion to secure the bracket 14 and the center post 11. Nuts **63*a* and 63*b* are welded to the upper and the lower surfaces of the central portion of the channel member 51, respectively. A fixing bolt 61 to engage with these nuts 63*a* and 63*b* is provided and a supporting plate 65 is provided at a position corresponding to the end portion of the fixing bolt 61. The supporting plate 65 is firmly secured to the rear frame 2 together with a bracket 67. Thus arranged bracket 14 enables the post knob 35 to cause the seat frame 23, that is, the center post 11, to turn counter clockwise or clockwise around the shaft 55**.

In this embodiment, the seat frame 23 on which the seat 29 is fixed can shift upwards and downwards separately from the frame 1, so that the frame 1 is provided not only with the caster 21 but also the leveller 22 at the lower portion of the rear frame 2. As a result, the weight of the load device 19 is supported by the caster 21 and the leveller 22. Therefore, only the weights of the seat 29 and the user are added to the frame 23 and the seat post 31, which load weight is smaller than that of the first embodiment. As described in the foregoing, the present embodiment has an advantage of reducing weights of the seat frame 23, the seat post 31 and the like. In pedalling exercise in practice, however, the strength of the user's legs is added to the pedal shaft 3 and the force intends to turn the frame 1 supporting the load device 5 counterclockwise around the caster 21. As a result, the leveller 22 is lifted up from the floor 4 to lead unstable operation during the pedalling exercise.

In expectation of such a case, the fixing bolt 61 and the supporting plate 65 are provided for stable pedalling. More specifically, counter clockwise rotation of the frame 2 around the caster 21 leads to a reduction of an angle θ of the rear frame 2 to the bracket 14 after starting the pedalling as can be seen from FIG. 5. Therefore, preventing a lift of the leveller 22 requires the value of the angle θ not to be changed.

In FIG. 7, with the position of the seat frame 23, that is, the position of the center post 11 adjusted, the fixing bolt 61 is engaged with the nuts 63*a* and 63*b* and the bolt is adjusted such that the end portion of the bolt 61 presses the supporting plate 65. Such adjustment of the fixing bolt 61 avoids a reduction of the angle θ of the bracket 14 to the rear frame 2. Therefore, even if force is applied to the pedal shaft 3 by the user during the exercise, the leveller 22 is not lifted, whereby the user is allowed to continue stable pedalling exercise.

Although in each of the above-described embodiments, the seat frame and the seat post etc. are made of square pipes, they can be structured by other polygonal pipes or circular pipes.

In addition, while the second embodiment includes the fixing bolt 61 and the supporting plate 65 to prevent a lift of the load device, other methods are also applicable to prevent a reduction of the angle θ.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An exerciser by which a user practices a pedalling exercise in a reclining position, comprising:

a support frame incorporating a load device for applying a load responsive to rotation of a pedal shaft, which is adapted to be rotated by pedal means secured thereto that are actuated by the user, a seat for supporting a user a seat frame to which the seat for the user is fixed and having one end connected to said (load portion) support frame, an end frame fixed to the other end of said seat frame, said seat frame having a generally tubular form, a seat post shaped to be slidable into said end frame and having one end located on a floor, and fixing means for fixing said end frame at a desired slide position of said seat post, said fixing means including a plurality of first openings provided on said seat post at predetermined intervals, a second opening provided on said end frame and having the same size as that of said first openings, and a rod which can penetrate through the first and second openings to fix said end frame and said seat post in the case where one of said first openings and said second opening are overlapped with each other by sliding movement of said end frame and said seat post with respect to one another, and levelling means affixed to the seat post for adjusting the horizontal position of the seat with respect to the floor.

2. The exerciser according to claim 1 wherein said seat flame is rotatably connected to said support frame.

3. The exerciser according to claim 2 wherein said support frame includes a rear frame for supporting the load device and connected to said seat frame, and the exerciser further includes preventing means for preventing a reduction of an angle of said seat frame to said rear frame.

4. An exerciser by which a user practices a pedaling exercise in a reclining position, comprising:

a support frame, a pedal shaft on said support frame, pedal means on said pedal shaft for rotating said pedal shaft to apply a load to a rotatable means, a seat for supporting a user, a seat frame to which the seat for the user is fixed, said seat frame having one end connected to said support frame, an end frame fixed to the other end of said seat frame and having a generally tubular form, a seat post shaped to be slidable into said end frame and having one end located on a floor, and fixing means for fixing said end frame at a desired slide position of said seat post, said support frame including a supporting portion, wherein said support frame and said seat frame are rotatable around said supporting portion of said support frame for facilitating vertical adjustment of said seat, and levelling means for adjusting the horizontal position of the end frame with respect to the surface upon which the exercise is supported, wherein the levelling means comprises an elongated leveller member secured to the seat post and at least one leveller pipe rotatably and eccentrically carried on the leveller member, whereby rotation of the leveller pipe on the leveller member will adjust the horizontal relationship between the leveller member and said surface.

5. An exerciser as in claim 4 wherein the exterior surface of the leveller pipe has flat portions thereon.

6. An adjustable recumbent bicycle exerciser by which a user practices a pedalling exercise in a reclining position, comprising a first frame, a pedal shaft on said first frame, pedals on said pedal shaft for rotating said pedal shaft to apply a load to a rotatable means, a center post connected to said first frame, a second frame slidably secured to said center post, a lock pin for locking the second frame to the center post in a selected position, a seat on the second frame facing the first frame and supporting the user, the second frame being slidably adjustable to adjust the position of the seat carried thereon with respect to the pedal shaft, an end frame secured to the second frame and having an opening therein, a seat post slidable in said opening in the end frame, a fastener for securing the seat post in a selected position in said end frame, and levelling means secured to the seat post for adjusting the horizontal position of the seat with respect to the floor.

7. An adjustable recumbent bicycle exerciser as in claim 6 wherein the center post is fixedly secured to the first frame.

8. An adjustable recumbent bicycle exerciser as in claim 6 wherein the center post is pivotally secured to the first frame.

9. An adjustable recumbent bicycle exerciser as in claim 7 including a bracket pivotally secured to the first frame, the center post being secured to said bracket, and a fixing bolt adjustably secured to said bracket and engaging the first frame for helping maintain a predetermined orientation of the center post with respect to the first frame.

10. An adjustable recumbent bicycle exerciser as in claim 6 wherein said levelling means includes an elongated leveller member secured to the lower end of the seat post and at least one leveller pipe rotatably and eccentrically carried on the leveller member, whereby rotation of the leveller pipe on the leveller member will adjust the horizontal relationship between the leveller member and the surface upon which the exerciser is supported.

* * * * *